US008337668B2

(12) United States Patent
Berendes et al.

(10) Patent No.: US 8,337,668 B2
(45) Date of Patent: Dec. 25, 2012

(54) DOCTOR BLADE WITH SENSING SYSTEM

(75) Inventors: Antje Berendes, Bergatreute (DE); Norbert Gamsjäger, Bad Fischau (AU)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/226,097

(22) Filed: Sep. 6, 2011

(65) Prior Publication Data

US 2012/0055646 A1 Mar. 8, 2012

Related U.S. Application Data

(63) Continuation of application No. PCT/EP2009/052682, filed on Mar. 6, 2009.

(51) Int. Cl.
*B31F 1/12* (2006.01)

(52) U.S. Cl. ..... 162/281; 162/198

(58) Field of Classification Search ..... 162/281, 162/263, 198, 111, 289
See application file for complete search history.

(56) References Cited

U.S. PATENT DOCUMENTS

| | | | | |
|---|---|---|---|---|
| 7,108,766 | B1 | 9/2006 | Eskelinen et al. | |
| 2005/0223513 | A1 | 10/2005 | Mau et al. | |
| 2010/0300209 | A1 * | 12/2010 | Kreuzer et al. | 73/800 |

FOREIGN PATENT DOCUMENTS

| | | | |
|---|---|---|---|
| DE | 10-2007-008-464.3 | * | 2/2007 |
| DE | 10 2008 023 966 | A1 | 11/2008 |
| GB | 2400434 | A | 10/2004 |

OTHER PUBLICATIONS

International Search Report and Written Opinion dated Dec. 15, 2009. (14 pages).

* cited by examiner

*Primary Examiner* — Mark Halpern
(74) *Attorney, Agent, or Firm* — Taylor IP, P.C.

(57) ABSTRACT

A blade for doctoring a moving surface or for sizing or creping a fibrous material web produced or finished in a web machine, for example in a paper, board or tissue machine, includes at least one fiber optic waveguide arranged on a surface of the blade or embedded in the material of the blade. The at least one fiber optic waveguide includes a fiber core and a fiber cladding. The at least one fiber optic waveguide further includes at least one fiber Bragg grating.

23 Claims, 3 Drawing Sheets

DOCTOR BLADE WITH SENSING SYSTEM

CROSS REFERENCE TO RELATED APPLICATIONS

This is a continuation of PCT application No. PCT/EP2009/052682, entitled "DOCTOR BLADE WITH SENSING SYSTEM", filed Mar. 6, 2009, which is incorporated herein by reference.

BACKGROUND OF THE INVENTION

1. Field of the Invention

The present invention relates to a blade for doctoring of a roll or similar moving surface, sizing or creping of a fibrous material web in a machine for the production and/or finishing of a web, for example of a paper, board or tissue web, the blade including means or devices for the measurement of pressure, force or other operating parameters.

2. Description of the Related Art

The rate of wear of a blade in a paper machine varies significantly. Depending on the blade's position, its working life can vary from hours to days. The degree of wear and condition of the blade thus is a valuable piece of information. If the degree of wear is known, replacements can be predicted and failure can be noticed immediately. If a worn-out or damaged blade is used, the doctoring or creping result will be poor. Also the blade unit or even the surface being doctored can be damaged by a worn doctor blade. There are few effective means or methods for monitoring the condition of the blade while the paper machine is in operation.

The wear of the blade and the doctoring result are particularly affected by the blade load and the blade angle. Usually, a doctor blade is pressed against the surface being doctored by a load imposed on the blade. In known doctor units, the loading devices are calibrated when the paper machine is stopped. The results obtained can thus only be used to give a very rough estimation of the desired blade load. The method can also be applied to determine the blade load during operation, but the method is complicated and the results are inaccurate. These methods also do not provide values for the blade-load over the width of the doctor blade, which would be important information for monitoring the doctoring result and the wear of the doctor blade.

In the state of the art several means or devices for the measurement of operating parameters of a doctor blade in the form of sensors like piezo-electric sensors or strain gauges are described. For example, document DE 10 2008 023966 A1 discloses a pressure setting device having a doctor blade to clean the surface of a roll or cylinder and a measuring device including an analyzing element, which is fitted between the doctor blade and the surface being cleaned. The cylinder is static when the blade pressure is being set. The measuring device may extend over the entire length of the blade. U.S. Patent Application Publication No. 2005/223513 A concerns a calibration device for the pressure of a scraping device blade, which abuts the periphery of a roller or cylinder, comprising a holding blade, a sensor holder mounted thereto, and a pressure sensor, wherein the holding blade, the sensor holder and the pressure sensor are positioned such that the position of the pressure sensor on the periphery of the roller or cylinder corresponds to the position of abutment of the blade. The sensor is a piezo-electrical sensor.

Apart from electrical sensors, also fiber optic sensors are used for monitoring the pressure conditions in a paper machine. Fiber optic sensors generally use a fiber optic waveguide as a sensing element, whereby a strain exerted on the fiber is determined by the impact of the strain on the fiber's optical properties.

U.S. Pat. No. 7,108,766 B shows a doctor unit in a paper machine including a blade carrier having a blade holder fitted to the blade carrier. A doctor blade is mountable in the blade holder to doctor a roll or similar moving surface. The blade holder and/or doctor blade include one or more optical sensors installed inside the construction or on its surface. The sensors are arranged to measure the wear of and/or stress in the blade holder and/or doctor blade.

In conventional fiber optics the strain or bending induced variation in the intensity of light passing the fiber is used as a measurement signal. But since measurement signals obtained by these effects carry no information regarding the location of the signal's origin, it is not possible to determine the position where the optical properties of the fiber have been changed.

A possibility to gain information about the position of the signal's origin is to use more fibers with only one sensor each or to assign a detection unit to each of the sensors. Both possibilities are highly demanding on the technical side and, therefore, expensive in realization.

What is needed in the art is an improved fiber optic sensing system for a doctor blade which avoids the drawbacks of the state of the art and provides a system which allows for determination of a position and strain signals of each sensor.

SUMMARY OF THE INVENTION

The present invention provides a blade for doctoring of a moving surface or for sizing or creping a fibrous material web produced or finished in a web machine, for example in a paper, board or tissue machine. The blade includes at least one fiber optic waveguide arranged on a surface of the blade or embedded in the material of the blade. The at least one fiber optic waveguide includes a fiber core and a fiber cladding. The at least one fiber optic waveguide further includes at least one fiber Bragg grating.

According to one embodiment of the blade of the present invention, the at least one fiber Bragg grating is oriented in a direction parallel to the machine direction or web moving direction, thus producing a strain to the grating and resulting in a measurable wavelength shift of the light passing the fiber. There may, for example, be multiple fiber Bragg gratings having different grating spacings. The multiple fiber Bragg gratings can be arranged in equal or in different distances along the fiber optic waveguide.

There can, for example, be multiple fiber Bragg gratings which are arranged in groups of several Bragg gratings along the fiber optic waveguide spaced by sections of fiber optic waveguide containing no Bragg gratings.

The length of a fiber optic waveguide section separating two groups of Bragg gratings has to be sufficiently long to enable a time-separated registration of light reflected in different groups of Bragg gratings. To enable measurements at different locations with only one fiber, more than one Bragg grating with different grating spacings are provided. This allows identification of the Bragg grating giving rise to a measuring signal by the wavelength of the signal. A respective measuring method is called wavelength multiplexing.

According to another embodiment of the present invention, the grating spacings of Bragg gratings within one group of Bragg gratings may correspond to the grating spacings of Bragg gratings within another group of Bragg gratings. This allows use of a multitude of groups and better coverage of the chosen wavelength range.

All parts of the fiber containing a group of Bragg gratings are, for example, oriented parallel to the machine direction, and the sections of the fiber Bragg sensor separating two groups of Bragg gratings can be oriented arbitrarily. Thus a multitude of Bragg gratings can be arranged in the blade without the 'delay' sections resulting in an increased distance between Bragg gratings.

A number of arrangements of the at least one fiber optic waveguide are feasible and may include arrangements on a top surface and/or on a bottom surface of the blade, an extension of the at least one waveguide over the top and bottom surfaces of the blade, or a partial or full embedding of the waveguide between layers of the material forming the blade.

According to an additional embodiment of the present invention, at least one of the Bragg gratings can be orientated in a direction parallel to the length direction of the blade to measure the strain by temperature of the blade. This gives the possibility of calibration of the other gratings.

According to another embodiment of the present invention two or more fiber optic waveguides can be provided. The two or more fiber optic waveguides can be arranged on one of the surfaces of the blade, on each of the surfaces of the blade, embedded in the blade or partially embedded and partially arranged on the surfaces of the blade. Thus it is possible to arrange the gratings in arrays as close as necessary to cover the whole blade.

One of the two or more fiber optic waveguides can be arranged in a direction parallel to the longitudinal extension of the blade, thus giving the possibility to produce a temperature profile of the blade. This is very important information since the temperature profile gives evidence of stress or load peaks in the blade which could damage the blade or even the surface to be doctored.

The blade can be made from any material used for doctor, caring or creping blades, like metal, for example steel or stainless steel, or a composite material including fibers, for example glass, carbon or aramide fibers, in a matrix material, such as in a resin, which can be produced by pultrusion, laminating or tailored fiber placement or similar production methods used for the production of blades.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
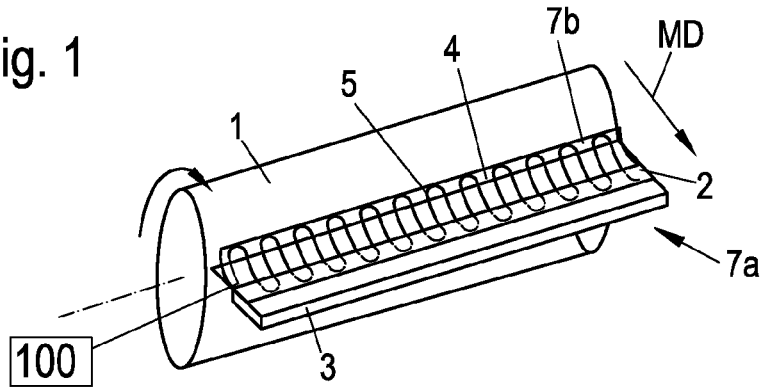
FIG. 1 shows a schematic view of a roll of a fibrous material web machine with a caring or doctor blade according to the present invention.

Referring now to the drawings, and more particularly to FIG. 1, there is shown a schematic view of roll 1, for example roll 1 for a machine for the production or finishing of paper, board or tissue, with doctor assembly 2 which is used for caring or doctoring the surface of roll 1. The present invention may also be applied to creping blades of tissue machines or doctors for coating or sizing. Doctor assembly 2 of the present invention is more specifically configured to observe operating parameters of doctor assembly 2, for example forces, pressure and temperature exerted on doctor assembly 2.

Doctor assembly 2 includes blade holder 3 and blade 4 which may be removably connected to blade holder 3. If blade 4 is designed as doctor blade to remove stickies or other contaminations from the surface of roll 1, it is necessary to press blade 4 against the surface. This pressure results in a deformation or bending of blade 4. This deformation can be used to measure the pressure exerted on blade 4.

As mentioned above, several systems for measurement or monitoring of the forces acting on blade 4 are known. A possibility is the use of fiber optic waveguide 5 arranged on or embedded in blade 4. In the core of fiber optic waveguide 5, structures in the form of gratings 6 can be inscribed, which act as interference points and reflect light which passes waveguide 5 at a specific wavelength according to the physical properties of gratings 6.

Gratings 6 are so-called Bragg gratings 6, consisting of a sequence of variations in the refractive index of the fiber core along the longitudinal direction of fiber optic waveguide 5. Depending on the respective measurement problem, the distances between consecutive changes in the (typically two) refractive indices (so-called grating spacings) are constant or vary within one Bragg grating 6. Light passing the core of the optical fiber is partially reflected at each refractive index changeover, with the coefficient of reflection depending on the refractive indices involved and the wavelength of the light. Multiple reflections at a sequence of changeovers in the refractive index lead to either a constructive or destructive interference. Therefore, only one wavelength will be (at least partly) reflected, when the grating spacing of Bragg grating 6 is constant, and multiple wavelengths will be reflected, when the grating spacing within one measuring section varies. The wavelengths of the reflected light and the coefficient of reflectance achieved depend on the grating spacings used, the refractive indices involved and the grating length given due to the number of refractive index changeovers present in a measuring section.

When the measuring section, i.e. the section of the fiber containing Bragg grating 6, is exposed to strain, the grating spacings change thereby causing a proportional shift in the wavelength of the light reflected at grating 6. A measurable wavelength shift is only obtained when the section of an optical fiber containing Bragg grating 6 is stretched or compressed along its longitudinal direction. Forces acting transverse to the fiber axis do not provoke a measurable change in the grating spacings but only minor Bragg wavelength shifts by photo-elastic effects.

When using more than one measuring section within one fiber optic waveguide 5, the measurement signals have to be assigned to their respective measuring section of origin.

A method of identifying the measuring section from which a certain light reflection originates is based on a determination of the time interval between the launching of a light pulse into the fiber optic waveguide and the detection of a light echo reflected from one of Bragg gratings 6 in the fiber.

Instead of time multiplexing, wavelength multiplexing can be used for identifying a measuring section giving rise to a certain measuring signal. In this case, the grating spacing of one Bragg grating 6 differs to any grating spacing of another Bragg grating formed in the same fiber. Accordingly the basic wavelength of a light echo produced on one grating differs from that produced on each of the other gratings. In this context it is noted that the term "light echo" as used in this specification refers to the light reflected on Bragg grating 6 in a fiber optic waveguide 5, fiber optic waveguide 5 having one or more Bragg gratings 6 formed within its fiber core. The term "basic wavelength" as used in this specification refers to the wavelength of a light echo produced with Bragg grating 6 not exposed to strain. The spacing between the basic wavelengths of the different Bragg gratings 6 of a fiber optic waveguide 5 is usually chosen longer than the wavelength shifts expected for waveguide 5 when used as designed for.

When fiber optic waveguides 5 with more than one Bragg grating 6 are used, Bragg gratings 6 favourably differ from each other by their respective grating spacings. Thus the wavelength range in which a measurement signal is found allows the identification of grating 6 from which the signal originates. Since the wavelength of light reflected on Bragg grating 6 shifts according to the strain present there, the variation of the grating spacings from Bragg grating 6 to Bragg grating 6 has to yield a higher wavelength shift caused by the maximum allowable strain at grating 6.

To yield a measurable strain on Bragg grating 6 implemented in blade 4 the sections of the fiber optic waveguide 5 containing gratings 6 have to be oriented in a direction parallel to the direction of movement of the web in the machine, as indicated by the arrow MD (machine direction) in FIG. 1. When the width of blade 4 is very small also an orientation under an angle between grating 6 and MD is possible.

Generally Bragg gratings 6 can be spaced apart in identical or different distances to each other. Also the distance between Bragg gratings 6 and the working edge of blade 4 can be variable. Best results will of course be achieved with the gratings 6 in the area of strongest deformation of blade 4. To allow a long operation time fiber optic waveguide 5 may be arranged some distance off the working edge to make sure that wear doesn't damage waveguide 5 early.

The minimum distance between two Bragg gratings 6 usually is about 10 centimeters (cm) due to the manufacturing process of fiber optic waveguide 5 and the inscription of gratings 6 with a number of five to 25 gratings 6 per fiber 5 depending on the measurement conditions. Each grating 6 has a length of about 5 to 6 millimeters (mm). The wavelength range covered by the gratings 6 lies in an area of 810 to 860 nanometers (nm) (+/−10 nm) or 1500 to 1600 nm. Typical waveguide 5 has a diameter of about 200 (+/−20) micrometers (μm) with a core diameter of about 125 μm. The reflexivity of gratings 6 is around 20%, thus yielding a signal strong enough for detection.

The temperature stability of fiber optic waveguide 5 is up to approximately 200° C., thus allowing operation in the hot damp environment of a paper machine. The coating of the core is usually an Omocer (organically modified ceramics). Due to the materials used in the core and in the coating fibers 5 allow an elongation of about 5% of their length when under load.

Figure 2:
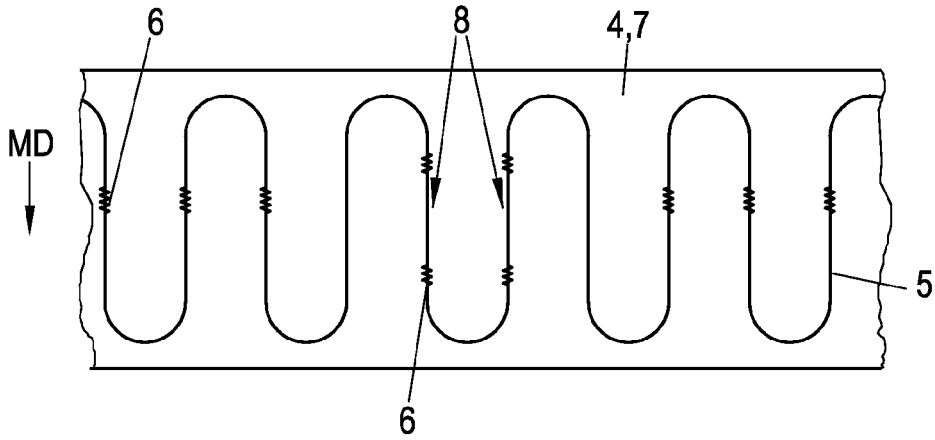
FIG. 2 shows a top view of a first embodiment of a doctor blade with a fiber optic waveguide according to the present invention.

A first embodiment of fiber optic waveguide 5 in blade 4 can be seen in FIG. 2, where one waveguide 5 with numerous Bragg gratings 6 is placed on surface 7 of blade 4. Waveguide 5 is arranged in a serpentine or sinuous like manner, thus orientating gratings 6 in machine direction (indicated by arrow MD). The deformation of blade 4 when brought in contact to the surface results in a strain of waveguide 5 and consequently of gratings 6 with a shift of the wavelength of the light which passes waveguide 5.

Referring to FIG. 1, when blade 4 is bent upwards, gratings 6 are elongated when waveguide 5 is placed on lower surface 7*a* of blade 4 and shortened when waveguide 5 is placed on upper surface 7*b* of blade 4. Waveguide 5 can also be arranged in the material of blade 4, e.g. in case blade 4 consists of layers of material which are laminated or consist of layers of prepregs or fibers.

When the at least one waveguide 5 is arranged on the surface of blade 4, there are different possibilities to fasten the fiber to the blade material. On the one hand, gluing or covering with an adhesive film is an easy way to arrange fiber 5 on blade 4. On the other hand, methods like vulcanization of the fiber on the blade material or coating of the blade with fiber 5 attached to it are possible. Generally the results will be the better, if the adhesion of fiber 5 to blade 4 in the area of gratings 6 is high. The portions of fiber 5 not containing gratings theoretically do not have to be fastened to blade 4, but fiber 5 is safely stowed away when the whole fiber 5 is covered.

As shown in FIG. 2, there are portions of waveguide 5 where single gratings 6 are located on each loop of waveguide 5. In some regions more gratings 6 can form group 8 to apply the above-mentioned wavelength multiplexing method for analysis. Gratings 6 can be arranged in waveguide 5 according to the preferred analysis method, the desired accuracy and so on.

Figure 3:
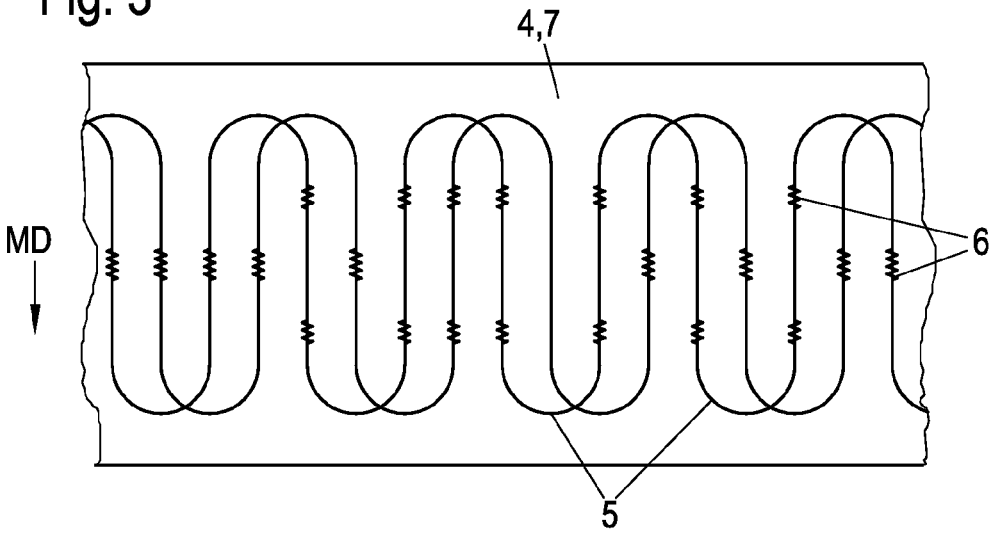
FIG. 3 shows a top view of a second embodiment of a doctor blade with a fiber optic waveguide according to the present invention.

It is also possible, as shown in FIG. 3, to arrange more than one waveguide 5 on or in blade 4. In the second embodiment of the present invention two waveguides 5 with single Bragg gratings 6 and groups 8 of Bragg gratings 6 are shown. The loops of two waveguides 5 are substantially parallel to another, gratings 6 being only arranged in portions being parallel to the machine direction again. No gratings 6 are to be found in the areas where two waveguides 5 cross each other. It is also possible to group gratings 6 of two fibers 5, thus allowing a very dense coverage of blade's 4 surface 7.

Figure 4:
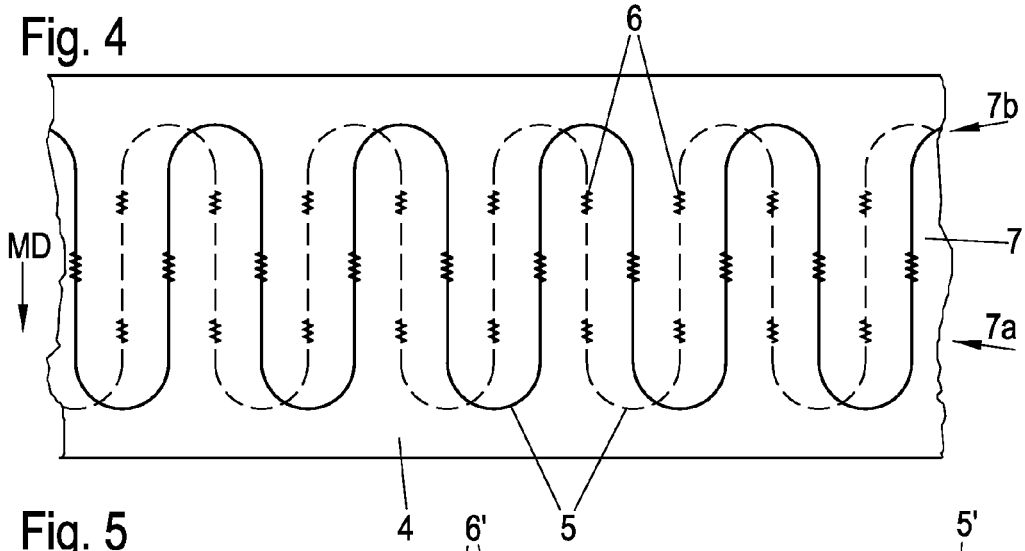
FIG. 4 shows a top view of a third embodiment of a doctor blade with a fiber optic waveguide according to the present invention.

In FIG. 4 yet another embodiment is shown, where either one single waveguide 5 meanders across lower and upper surface 7*a*, 7*b* of blade 4 or two waveguides 5 are placed on blade 4 with one waveguide 5 being situated on each surface 7*a*, 7*b* of blade 4.

Figure 5:
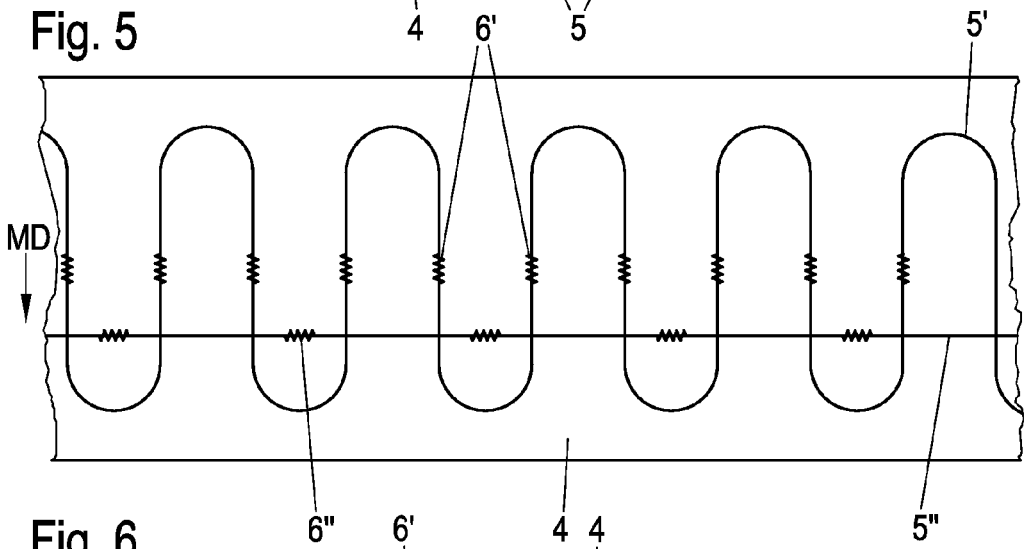
FIG. 5 shows a top view of a fourth embodiment of a doctor blade with a fiber optic waveguide according to the present invention.

In FIG. 5 an additional embodiment is shown with first fiber 5' meandering over blade 4 as described above and second fiber 5" stretching in a direction parallel to the elongation of blade 4 (CMD; cross machine direction).

Gratings 6" of second fiber 5" are likewise orientated in CMD, thus not being elongated or shortened by the load on blade 4 like gratings 6' of fiber 5'. Fiber 5" can be used for temperature measurements. Due to the fact that in fiber optic waveguide 5 an elongation due to temperature differences can occur, it is on the one hand possible to calibrate the other at least one fiber 5' in blade 4 to eliminate the effect of elongation by temperature, and on the other hand to determine a temperature profile over the length of blade 4 during operation. The temperature profile may show irregularities in the load exerted or blade 4 and thus is suitable to prevent damage to blade 4 and the surface of roll 1.

Figure 6:
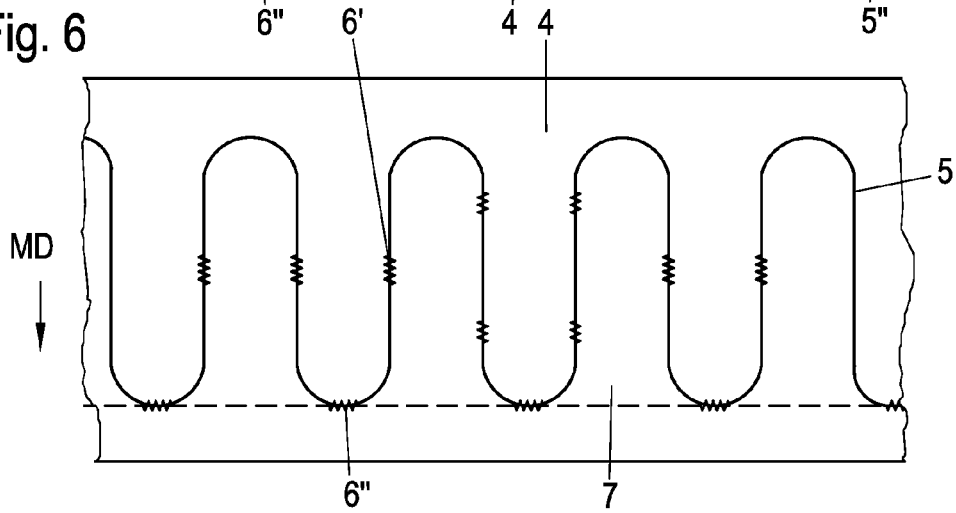
FIG. 6 shows a top view of a fifth embodiment of a doctor blade with a fiber optic waveguide according to the present invention.

In FIG. 6 another embodiment similar to that shown in FIG. 5 is shown, with only one single waveguide 5, but with Bragg gratings 6' oriented in MD for strain measurements and Bragg gratings 6" oriented in CMD for temperature measurements. By a suitable sampling method all values derived from different gratings 6', 6" can be used at the same measuring cycle.

Figure 7:
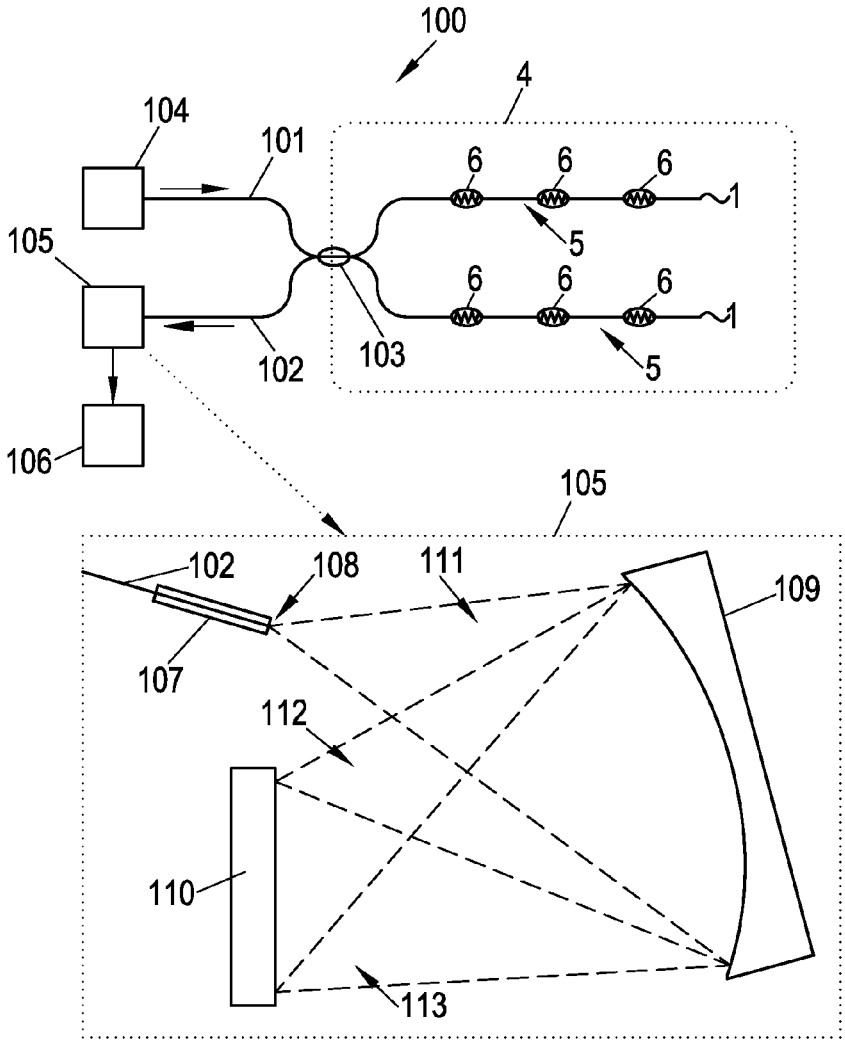
FIG. 7 shows a schematic representation of a fiber optic measurement system for monitoring of operating parameters in blades according to the present invention.

The illustration of FIG. 7 shows a schematic representation of fiber optic measurement system 100 using two fiber Bragg waveguides 5 according to one of the embodiments of the present invention described above.

As shown schematically in FIG. 1, measuring system 100 is arranged somewhere apart from blade 4, e.g. on a control table for paper machine operation.

Although fiber 5 is shown with only four Bragg gratings 6, it is appreciated by a person skilled in the art that the number of gratings 6 within fiber 5, as well as the number of fibers 5 used in total, is determined according to the given measurement task and is not limited to the illustrated embodiment.

The upper part of FIG. 7 shows the principle configuration of fiber optic measurement system 100, and the lower part of FIG. 7 contains a schematic representation of spectral sensor 105 used in system 100.

Broadband light source 104, like for instance a Superluminescent Light Emitting Diode (SLED), emits light within a certain wavelength range, e.g. a range from about 810 nanometers (nm) to about 860 nm. The light is propagated via fiber optic output 101 and following fiber optic coupler 103 in a fiber optic sensor array formed by one or more fiber optic gratings 6 embedded in or arranged on blade 4. Fiber optic waveguides 5 are, for example, preferably formed by single-mode fiber optic waveguides 5 having Bragg gratings 6 inscribed therein. The average grating spacings of the measurement sections differ from each other for enabling a wavelength multiplex measurement.

For increasing the number of measurement sections within one fiber 5, Bragg gratings 6 are aggregated in groups 8 as e.g. indicated in FIG. 2. Within group 8, a different grating spacing is used for each Bragg grating 6. In different groups 8 equal or similar grating spacings are used. Fiber sections containing no Bragg gratings 6 separate groups 8 from each other. Those sections have a considerable length in order to enable a clear distinction of the optical measurement signals by the different propagation times involved with the different distances of groups 8 of Bragg gratings 6 to the light source and spectral sensor 105. Fiber optic measurement system 100 using respective fiber optic waveguide 5 is referred to as a combined wavelength multiplex and time multiplex system. The length of the optical fiber 5 between two groups 8 of gratings 6 has to be long in relation to the dimension of groups 8.

Light reflected at various Bragg gratings 6 exits fiber optic waveguide 5 at coupling means 103 and passes into fiber optic waveguide 102 leading to polychromator 105 serving as a spectral sensor for the wavelength sensitive conversion of the optical measurement signals into electrical signals. The spectral information carrying electric measurement signals are then transferred to signal processing device 106 which may be implemented in part at the location of polychromator 105 and in part remote thereto. Since the remote part is usually not on blade 4 supporting fiber optic waveguide 5, data are, for example, exchanged between the two or perhaps more parts of signal processing device 106 by a radio link.

The lower part of FIG. 7 shows the basic configuration of polychromator 105 that may be used as the spectral sensor. Light enters the configuration via entry cleavage 108 at the exit of coupling element 107 terminating fiber optic waveguide 102. Emitted light beam 111 widens and illuminates reflective grating 109 having a curved surface. The curvature of the grating is adapted to focus each spectral component 112, 113 of light beam 111 onto a different location of photosensitive means 110, like, e.g., a Charge Coupled Device (CCD), outputting the electrical signals according to the location of their respective generation.

Light source 104, waveguides 101 and 102, coupler 103, spectral sensor 105, and the local module of signal processing device 106 are as mentioned above may be mounted in a housing stored away safely to shelter the delicate components.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blade for doctoring, sizing or creping a moving surface or a fibrous material web produced in a web machine, the blade comprising:

at least one fiber optic waveguide one of arranged on a surface of the blade and embedded in a material of the blade, said at least one fiber optic waveguide including a fiber core, a fiber cladding and a plurality of fiber Bragg gratings, said plurality of gratings being arranged in a plurality of groups along said fiber optic waveguide, said plurality of groups being spaced apart from each other by a plurality of sections of said fiber optic waveguide having none of said fiber Bragg gratings.

2. The blade according to claim 1, wherein the web machine is one of a paper machine, a board machine and a tissue machine.

3. The blade according to claim 1, wherein said plurality of fiber Bragg gratings are oriented in a direction which is parallel to a machine direction.

4. The blade according to claim 1, wherein said plurality of fiber Bragg gratings have different grating spacings.

5. The blade according to claim 4, wherein said plurality of fiber Bragg gratings are arranged in equal distances along said fiber optic waveguide.

6. The blade according to claim 1, wherein each of said plurality of fiber Bragg gratings within said groups of Bragg gratings have different grating spacings.

7. The blade according to claim 6, wherein a length of a section of said fiber optic waveguide separating two of said plurality of groups of said fiber Bragg gratings is sufficiently long to enable a time-separated registration of light reflected in different of said groups of said fiber Bragg gratings.

8. The blade according to claim 7, wherein a first set of grating spacings of a first group of said plurality of fiber Bragg gratings corresponds with a second set of grating spacings of a second group of said plurality of fiber Bragg gratings.

9. The blade according to claim 1, wherein said at least one fiber optic waveguide is arranged in a sinuous line one of on and in the blade.

10. The blade according to claim 1, wherein said at least one fiber optic waveguide is arranged on at least one of a top surface and a bottom surface of the blade.

11. The blade according to claim 10, wherein said at least one fiber optic waveguide extends over said top surface and said bottom surface of the blade.

12. The blade according to claim 1, wherein said at least one fiber optic waveguide is embedded between a plurality of layers of a material forming the blade.

13. The blade according to claim 1, wherein said plurality of fiber Bragg gratings are oriented in a direction parallel to a length of the blade.

14. The blade according to claim 1, wherein said at least one fiber optic waveguide is at least two fiber optic waveguides.

15. The blade according to claim 14, wherein said at least two fiber optic waveguides are arranged on said top surface or said bottom surface of the blade, on each of said top surface and said bottom surface of the blade, or partially embedded in or partially arranged on said top surface and said bottom surface of the blade.

16. The blade according to claim 14, wherein one of said at least two fiber optic waveguides is arranged in a direction parallel to a longitudinal extension of the blade.

17. The blade according to claim 1, wherein the blade is metal.

18. The blade according to claim 17, wherein said metal is one of steel and stainless steel.

19. The blade according to claim 1, wherein the blade is a composite material including a plurality of fibers in a matrix material.

20. The blade according to claim 19, wherein said plurality of fibers are one of glass, carbon and aramide fibers.

21. The blade according to claim 19, wherein said matrix material is a resin.

22. The blade according to claim 19, wherein said composite material is produced by one of pultrusion, laminating, and tailoring fiber placement.

23. The blade according to claim 19, wherein said at least one fiber optic waveguide is fixed to the blade by one of glue, an adhesive film, and vulcanization.

* * * * *

UNITED STATES PATENT AND TRADEMARK OFFICE

CERTIFICATE OF CORRECTION

PATENT NO. : 8,337,668 B2
APPLICATION NO. : 13/226097
DATED : December 25, 2012
INVENTOR(S) : Antje Berendes et al.

It is certified that error appears in the above-identified patent and that said Letters Patent is hereby corrected as shown below:

TITLE PAGE

Item (75), Inventors: please delete "(AU)", and substitute therefore --(AT)--.

In the Claims

COLUMN 10, LINE 15

In claim 23, please delete "19", and substitute therefore --1--.

Signed and Sealed this
Twenty-second Day of October, 2013

Teresa Stanek Rea

Teresa Stanek Rea
*Deputy Director of the United States Patent and Trademark Office*